United States Patent [19]

James et al.

[11] Patent Number: 4,712,387

[45] Date of Patent: Dec. 15, 1987

[54] COLD PLATE REFRIGERATION METHOD AND APPARATUS

[76] Inventors: Timothy W. James, 325 Ladera #7, Santa Barbara, Calif. 93101; David Wyman, 4727 Calle Reina, Santa Barbara, Calif. 93110

[21] Appl. No.: 34,397

[22] Filed: Apr. 3, 1987

[51] Int. Cl.[4] ..... F25D 3/00

[52] U.S. Cl. ..... 62/434; 165/104.11; 165/104.21

[58] Field of Search ..... 62/119, 434, 498; 165/104.11, 104.11 A, 104.21

[56] References Cited

U.S. PATENT DOCUMENTS

| | | | |
|---|---|---|---|
| 2,436,389 | 2/1948 | Kleist | 165/104.11 X |
| 2,499,736 | 3/1950 | Kleen | 165/104.11 X |
| 2,597,744 | 5/1952 | Morrison | 165/104.11 X |
| 2,779,171 | 1/1957 | Lindenblad | 62/434 X |
| 2,911,513 | 11/1959 | MacCrackon | 165/104.11 X |
| 3,848,424 | 11/1974 | Rhea | 62/498 X |
| 4,003,214 | 1/1977 | Schumacher | 165/104.21 X |
| 4,129,014 | 12/1978 | Chubb | 62/434 X |
| 4,283,925 | 8/1981 | Wildfeuer | 165/104.11 X |
| 4,355,522 | 10/1982 | Gorski et al. | 165/104.21 X |
| 4,452,051 | 6/1984 | Berger et al. | 165/104.11 X |

*Primary Examiner*—William E. Tapolcai

*Attorney, Agent, or Firm*—BST&Z

[57] ABSTRACT

An improved cold storage refrigeration system and method is presented. A first heat exchanger located in a cold storage unit is connected by means of a series of vertical pipes to a second heat exchanger located below the first heat exchanger within a refrigerated space, forming an integrated tube assembly. To charge the cold storage unit, the tube assembly is operated as the evaporator of a conventional refrigeration circuit. During non-powered cooling, a portion of refrigerant is sealed within the tube assembly. The refrigerant vaporizes in the second heat exchanger and condenses in the first heat exchanger, thereby transferring heat from the refrigerated space to the cold storage unit. Defrosting of the second heat exchanger is accomplished by removing refrigerant from the second heat exchanger and circulating air above 0 degrees centigrade around it.

17 Claims, 3 Drawing Figures

COLD PLATE REFRIGERATION METHOD AND APPARATUS

BACKGROUND

1. Field of the Invention

The present invention relates to the field of refrigeration and more particularly, to refrigeration systems incorporating cold storage that are capable of essentially unpowered operation for substantial periods of time.

2. Prior Art

Heretofore various types of refrigeration/cooling apparatus have been disclosed that incorporate some form of cold storage. In some cases the cold storage is used to supplement the cooling capacity of the apparatus during peak load conditions, in other cases it is used to allow unpowered operation of the system at times when external power is expensive or unavailable.

These systems vary in their structural arrangement, the type of cold storage device used, the method used to transfer heat to and from the cold storage device, and in their cooling capacity: i.e. whether they can be utilized for air conditioning, refrigeration, or freezing.

U.S. Pat. No. 4,129,014 discloses a "Refrigeration Storage and Cooling Tank" in which the cold storage device consists of a gas tight housing containing a "heat pipe liquid" enclosing a number of containers of a freezable liquid. The gas tight housing contains two separate heat exchanger pipe assemblies: one is connected to a conventional refrigeration circuit and is used to "charge" the cold-storage device; the second is connected to an outside heat exchanger and contains brine. The brine is circulated to cool the outside heat exchanger. This system therefore uses three heat transfer fluids: the refrigerant in the refrigeration circuit, the "heatpipe liquid" in the gas tight housing, and the brine flowing through the outside heat exchanger.

U.S. Pat. No. 2,664,716 discloses a refrigeration system in which small containers containing a "congealable" eutectic liquid are used as cold storage devices. The containers are manually placed in a conventional freezer and frozen when excess cooling capacity is available. The stored cold is used to supplement the cooling capacity of the freezer at times of heavy cooling loads, as when large quantities of food must be rapidly frozen. The containers must be manually removed when they become discharged, or when the space they occupy is needed to store more frozen food.

U.S. Pat. No. 2,512,576 discloses a refrigeration system in which a tank of water is used as the cold storage device. During times of low cooling loads, refrigerant from a conventional refrigeration system is circulated through coils immersed in the water in the tank, cooling and freezing the water. At times of high cooling loads the ice is used to cool the refrigerant before it is circulated in a refrigerator or cooler. This system is not capable of non-powered cooling.

U.S. Pat. No. 2,246,401 discloses an air-conditioning system that also uses a tank of water as the cold storage device. The system comprises two refrigeration circuits: One is used to freeze the water in the tank at times of light cooling loads, the other to cool air, either directly or by first cooling water. In times of heavy cooling loads, two methods are disclosed of utilizing the cooling capacity of the ice in the tank. According to the first method, water from the melting ice is mixed with water cooled by the refrigeration machine and circulated through a heat exchanger over which air is blown. According to the second method, a portion of the refrigerant evaporated by the air being cooled, instead of passing through the compressor and condenser, passes through the water tank and is condensed by the melting ice. This system therefore requires two refrigeration circuits, and the stored refrigeration is used only to augment the cooling produced by a conventional refrigeration system.

U.S. Pat. No. 1,957,313 discloses a refrigeration system in which the cold storage device consists of an envelope of "cryohydrate composition" surrounding the refrigerated space. A refrigerant line is in thermal contact with both the refrigerated space and the cryohydrate composition. A conventional refrigeration machine is operated intermittently to freeze the cryohydrate. Once the cryohydrate is frozen, the refrigeration machine is turned off. Heat is transferred by conduction from the refrigerated space to the cryohydrate, causing it to melt. In this system, the cold storage device must be in direct physical contact with the refrigerated space.

U.S. Pat. No. 1,891,714 discloes a refrigerating system for use as an air conditioner in which water is used both as the cold storage medium and as a heat transfer fluid. A conventional refrigerating machine is used to cool water in a tank. The cooled water is then used to cool air. At times when there is only a small air-conditioning load, only part of the cooling capacity of the refrigerating machine is absorbed by the air. The water decreases in temperature and eventually starts to freeze. When the air-conditioning load is high, the water temperature rises, melting the ice. The heat absorbed by the melting ice supplements the cooling capacity of the refrigerating machine. This system therefore comprises two heat transfer circuits: one, a conventional refrigeration circuit used to cool the water, and two, a water circuit used to cool the air.

U.S. Pat. No. 3,744,264 discloses a refrigeration system that, while not incorporating a cold storage device, is capable of limited non-powered cooling. This system is comprised primarily of a conventional refrigeration system including a compressor, a condenser, expansion valve, and an evaporator. Both the condenser and the evaporator are shell and tube heat exchangers. Water to be cooled is circulated through the evaporator, cooling water is used to cool the condenser. The system is capable of non-powered cooling only when the condenser water is cooler than the evaporator water. In that case, a single separate refrigerant line is used to by-pass the compressor and form a direct link between the evaporator and the condenser. Refrigerant vaporized in the evaporator flows through the bypass line to the condenser, where if the condenser water is cool enough, it condenses. The refrigerant flows back to the evaporator. Since this system features only a single refrigerant line for non-powered cooling, its non-powered cooling capacity is extremely limited.

The cooling coils of a refrigeration system that is operated at temperatures below the freezing point, if exposed to moist air, generally require periodic defrosting to prevent excessive build-up of ice. In conventional defrosting systems, such as disclosed in U.S. Pat. Nos. 3,638,444 and 3,677,025, hot, compressed, refrigerant from the compressor is by-passed around the condenser and expansion valve directly to the evaporator, where it melts any accumulated frost.

SUMMARY OF THE INVENTION

The present invention comprises a novel cold storage refrigeration method that uses a single refrigeration circuit to produce the cold storage in the powered mode and to use the cold storage to cool the refrigerated space in the unpowered mode. The invention is capable of producing any desired temperature, including below freezing temperatures, in the nonpowered mode and provides for rapid defrosting of heat exchanger tubes when operated near or at below-freezing temperatures.

The distinctive features of this invention are to a great extent due to its heat transfer linkage between the cold storage unit, termed a "cold plate", and the refrigerated space. The cold plate and the refrigerated space each contain a heat exchanger. The heat exchanger located in the cold plate, (the "upper" heat exchanger) is situated at a higher elevation than the heat exchanger located in the refrigerated space (the "lower" heat exchanger). The heat exchangers, which may be of a variety of designs, are connected together by a multitude of vertical or nearly vertical tubes, forming an integrated heat-exchanger/tube assembly (the "tube assembly"). The tube assembly is connected to a conventional refrigeration circuit forming a closed refrigerant loop consisting of a compressor, a condenser, a reservoir, an expansion valve, and the tube assembly. In addition, an inlet valve, which may be a solenoid valve, is located between the reservoir and the tube assembly. The invention operates in three primary modes: cold plate charging/powered cooling, non-powered cooling, and defrosting.

During the cold plate charging/powered cooling mode the invention is operated like a conventional refrigeration system. Refrigerant, stored in a liquid state in the reservoir, flows through the expansion valve into the tube assembly. The pressure in the tube assembly is maintained at a level at which the boiling point of the refrigerant is below the storage temperature of the cold plate. Upon entering the tube assembly, the refrigerant vaporizes, absorbing heat from and cooling the cold plate and the refrigerated space. The vaporized refrigerant is compressed by the compressor, liquified by the condenser, and flows back into the reservoir. The cold plate charging/powered cooling mode of operation may continue until the cold plate has become fully charged, or longer if powered cooling is still desired.

Nonpowered cooling by the invention is possible whenever the cold plate is partially or fully charged. To initiate the nonpowered cooling mode, the compressor is shut off, and the inlet valve is left open. Refrigerant will now migrate to the tube assembly since it is the coldest part of the refrigeration circuit. The refrigerant will condense there until the pressure throughout the circuit is equal to the vapor pressure of the refrigerant at the temperature of the cold plate heat exchanger. In the preferred embodiment, establishing the proper liquid refrigerant level in the vertical heat pipes and lower heat exchanger is accomplished by appropriately fixing the volume of the entire refrigeration circuit and charging the circuit with the proper amount of refrigerant for efficient heat pipe operation.

Active control of the inlet valve could also be used to either automatically or manually control the amount of refrigerant admitted from the resevoir in applications where there is more refrigerant in the system than is desired in the heat pipes for nonpowered cooling.

Instead of operating as a conventional refrigerator heat exchanger, the tube assembly now operates as a series of vertical heat pipes, transferring heat from the refrigerated space to the cold plate. Condensed refrigerant, under the influence of gravity, collects in the lower heat exchanger, located in the refrigerated space. The refrigerated space is maintained at a temperature somewhat above the temperature of the cold plate or equivalently above the boiling point of the refrigerant in the tube assembly. The refrigerant contained in the lower heat exchanger therefore starts to boil. The resultant refrigerant vapor rises up the tubes into the upper heat exchanger located in the cold plate. There the vapor condenses, transferring the heat absorbed from the refrigerated space to the cold plate. Condensed refrigerant flows back down the tubes into the lower heat exchanger, where, once again, it is vaporized. Such nonpowered cooling can cool the refrigerated space to temperatures near the temperature of the cold storage media in the cold plate, and can continue until, as a result of heat being transferred from the refrigerated space, the temperature of the cold plate rises to that of the refrigerated space. At this point the cold plate would need to be recharged. A small electric fan and/or movable baffles can be used to regulate the flow of refrigerated air through the bottom heat exchanger in order to maintain a constant refrigerated temperature.

To accomplish defrosting of the lower heat exchanger (which is exposed to typically moist refrigerated air), the input valve to the tube assembly is closed and the compressor is turned on. The continued operation of the compressor rapidly lowers the pressure in the tube assembly to a point where any liquid refrigerant contained in the tube assembly is vaporized and transferred to the condenser and reservoir. Once all the liquid refrigerant has been removed from the tube assembly the upper and lower heat exchangers are effectively thermally isolated since the heat pipes are inactivated. Air above 0 degrees centigrade is then blown over the lower heat exchanger, melting and evaporating accumulated frost without transferring significant heat to the cold plate, which can remain in a charged (i.e. frozen) state during this cycle.

DETAILED DESCRIPTION OF THE INVENTION

An improved cold storage refrigeration system and method is presented. In the following description, for purposes of explanation, numerous details are set forth, such as specific materials, arrangements and proportions in order to provide a thorough understanding of the present invention. However, it will be apparent to one skilled in the art that the invention may be practiced without these specific details. In other instances, well known refrigeration components, such as valves, pumps, condensers, and heat exchangers have not been described in detail in order not to obscure the present invention unnecessarily.

Figure 1:
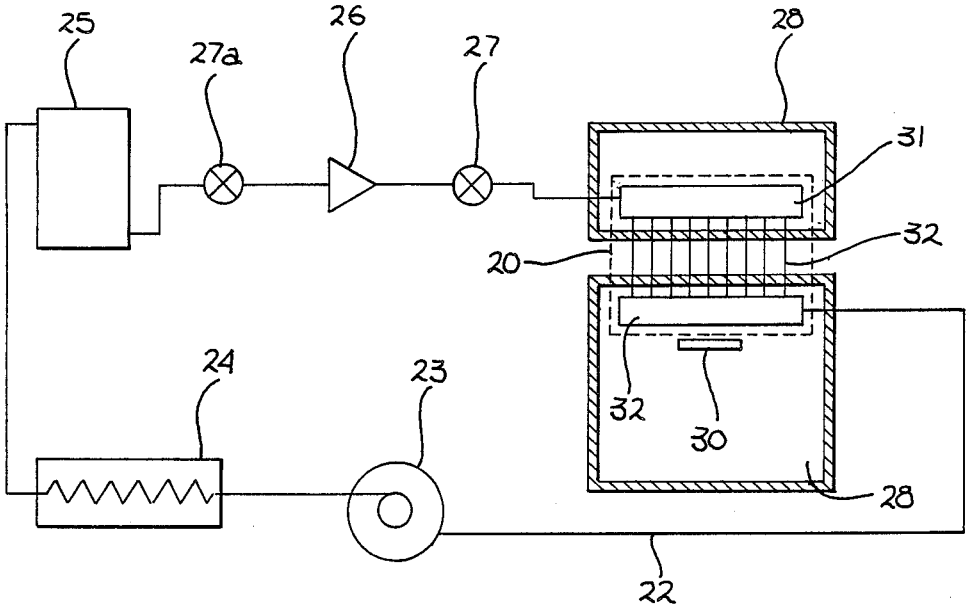
FIG. 1 is a schematic diagram illustrating a typical arrangement of the major components of the present invention.

Referring first to FIG. 1, the invention comprises a tube assembly 20, a compressor 23, a condenser 24, a refrigerant reservoir 25, an expansion means 26 (such as an expansion valve or capillary tube), an inlet valve 27, or 27*a*, a cold plate 28, a refrigerated space 29, and a circulation fan 30. The tube assembly 20, the inlet valve 27 or 27*a*, the compressor 23, the condenser 24, the refrigerant reservoir 25, and the expansion valve 26 are interconnected by piping 22 to form a closed refrigerant loop. The compressor 23, the condenser 24, the expansion means 26, and the refrigerant reservoir 25 are of the kind normally used in conventional refrigeration apparatus. The inlet valve 27 or 27*a* is a conventional, automatic, electrically driven, or manual valve that is capable of sealing off the flow through the tubes. The piping 22 is made of metal, plastic, or any other suitable material. The cold plate 28 consists of an insulated container filled with a substance or substances that are capable of absorbing and releasing quantities of heat. In the preferred embodiment, the cold plate 28 is filled with a eutectic or pure material exhibiting a phase change at the appropriate temperature for a particular application, i.e. air conditioning, refrigeration, or freezing. The refrigerated space 29 is an insulated enclosure containing one or more doors or openings in which food or other substances may be refrigerated or frozen. Alternatively, the refrigerated space 29 may be a room or other space, if the invention is used as an air conditioner. The tube assembly 20 is shown is greater detail in FIGS. 2 and 3.

Figure 2:
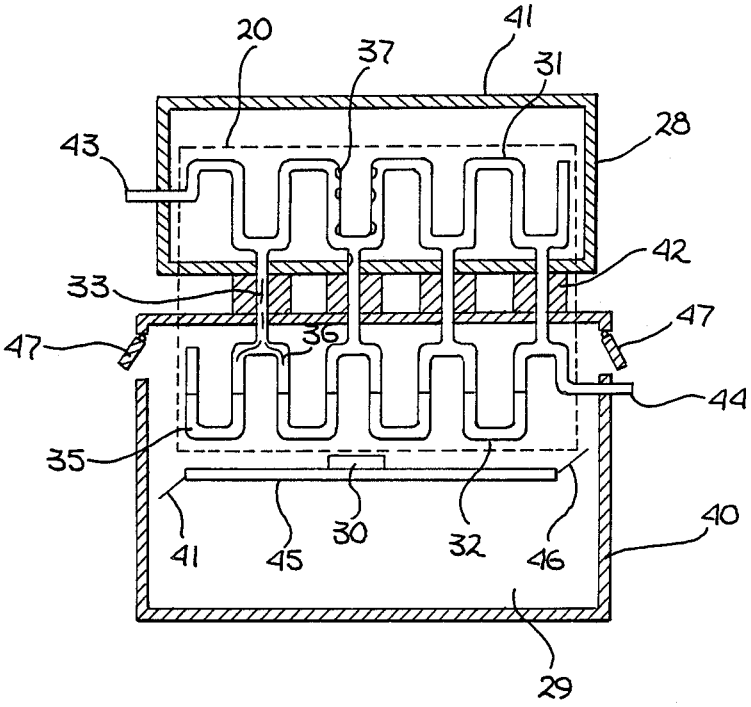
FIG. 2 is an illustration of the tube assembly illustrating its structure and its operation in the nonpowered cooling mode.

Referring to FIG. 2, the tube assembly 20 comprises an upper heat exchanger 31 situated within the cold plate 28, a lower heat exhanger 32 situated within the refrigerated space 29, and interconnecting tubes 33 that connect the lowermost sections of the upper heat exchanger 31 to the uppermost sections of the lower heat exchanger 32. The tubes 33 may be straight or bent but are shaped and situated in such a way that liquid refrigerant will flow freely from the upper heat exchanger 31 to the lower heat exchanger 32 under the force of gravity, and refrigerant vapor will rise freely from the lower heat exchanger 32 to the upper heat exchanger 31. The tubes 33 pass through the walls of the cold plate 28 and the refrigerated space 29, including any insulation 40 and 41 contained in the walls. Any exposed sections of the tubes 33 situated outside of the cold plate 28 or the refrigerated space 20 may be surrounded by insulating material 42. The refrigerated space 29 may or may not include baffles 46 or partitions 45 to control the air circulation around the lower heat exchanger. The heat exchangers 31 and 32 may have a variety of designs, and may be finned of unfinned.

Figure 3:
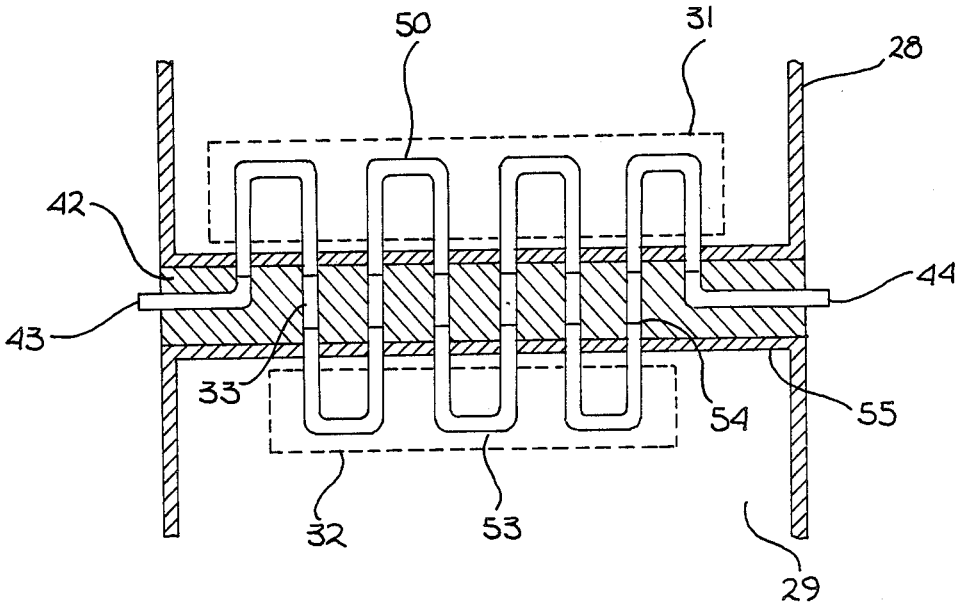
FIG. 3 is an alternative embodiment of the tube assembly.

The preferred embodiment of the tube assembly is illustrated in FIG. 3. Referring to FIG. 3, in this embodiment the upper heat exchanger 31 comprises a multiplicity of inverted-U-shaped sections of pipe 50, the upper sections of which protrude into the cold plate 28 and the bottom ends 51 of which penetrate the bottom outer wall 52 of the cold plate 28. Lower heat exchanger 32 comprises a multiplicity of U-shaped sections of tubing, the lower sections 53 of which protrude into the refrigerated space 29 and the upper ends 54 of which penetrate the upper wall 55 of the refrigerated space 29. Vertical tubes 33 connect the lower ends 51 of the inverted-U-shaped sections 50 with the upper ends 54 of the U-shaped section 53 forming a continuous, S-shaped tube assembly.

The refrigerant loop of the present invention may also include one or more valves or other flow control devices in addition to the inlet valve 27 and such flow control devices may be located anywhere within the refrigerant loop.

The invention has three modes of operation: Cold plate charging/powered cooling, nonpowered cooling, and defrosting.

During the cold plate charging/powered cooling modes, the inlet valve 27 is opened and the compressor 23 is turned on. Refrigerant flows from the refrigerant reservoir 25, where it is maintained in liquid form at a pressure $P_R$ sufficient to raise its boiling point to a temperature above room temperature, through the expansion means 26 and open inlet valve 27 into the tube assembly 20. For a refrigerant such as Freon 12 TM, $P_R$ is typically about 60–100 psig. The expansion valve reduces the pressure of the refrigerant from $P_R$ to $P_C$, a pressure sufficiently low to reduce the boiling point of the refrigerant to a temperature below the minimum temperature reached by the fully charged cold plate. For Freon 12, $P_C$ is on the order of 0–40 psig depending on the application, i.e. air conditioning, refrigeration or deep freezing. The refrigerant vaporizes in the tube assembly 20 and absorbs heat from and cools the cold plate 28 and the refrigerated space 29. The vaporized refrigerant leaves the tube assembly 20 and enters the compressor 23 where its pressure is raised back up to $P_R$. The hot, compressed refrigerant vapor is cooled and liquified in the condenser 24 and returns to the refrigerant reservoir 25. The cold plate charging/powered cooling mode may continue until the cold plate 28 is fully charged, as may be determined from the temperature of the cold plate 28. A thermostatic control may be used to turn off the compressor 23 and close the inlet valve 27 to the tube assembly 20 once the temperature of the cold plate 28 drops below a predetermined value. Powered cooling may be continued as required to cool the refrigerated space when non powered cooling is not required even though the cold plate if fully charged. If the cold plate 28 utilizes a eutectic phase change material, its temperature will remain essentially constant during charging, and will only begin to drop once the cold plate 28 is fully charged, i.e. when the eutectic material has completed it phase change. To prevent excessive cooling of the refrigerated space 29 during the cold plate charging mode, baffles 46 and partitions 45 may be fitted into the refrigerated space 29 to limit the circulation of the refrigerated air through the lower heat exchanger 32 during the cold plate charging mode, or the circulation fan 30 may be inactivated.

To operate in the nonpowered cooling mode, the compressor 23 is shut off, and the inlet valve 27 or 27*a* is left open. Refrigerant will now migrate to the tube assembly 20 since it is the coldest part of the refrigeration circuit. The refrigerant will condense there until the pressure throughout the circuit is equal to the vapor pressure of the refrigerant at the temperature of upper heat exchanger 31.

In the preferred embodiment, establishing the proper liquid refrigerant level in the vertical heat pipes and lower heat exchanger is accomplished by appropriately fixing the volume of the entire refrigeration circuit and charging with the proper amount of refrigerant for efficient heat pipe operation.

Active control of inlet valve 27 or 27*a* can also be used to either automatically or manually control the amount of refrigerant admitted from the resevoir 25 in applications where there is more refrigerant in the system than is desired in the heat pipes for nonpowered cooling.

Once the tube assembly 20 has been charged, nonpowered, or free, cooling will spontaneously begin. Referring to FIG. 2, the refrigerant within the tube assembly 20 will consist of a mixture of vapor and liquid. Through the force of gravity, the liquid 35 will collect in the lower heat exchanger 32. The vapor 36 will fill the remaining space including the upper heat exchanger. Since the temperature of the refrigerated space 29 is above the boiling point of the refrigerant, the liquid refrigerant 35 boils and vaporizes, absorbing heat from and cooling the refrigerated space 29. The vaporized refrigerant rises through tubes 33 into the upper heat exchanger 31, where, because the temperature of the cold plate 28 is lower than the boiling point of the refrigerant, it condenses. Condensed vapor droplets 37 collect on the walls of the upper heat exchanger 31 and flow back down through the tubes 33 to the lower heat exchanger 32. Each tube 33 therefore operates as a heat pipe, providing a very efficient transfer of heat from the refrigerated space 29 to the cold plate 28. Nonpowered cooling can continue until the temperature of the cold plate 28 rises, as a result of the heat transferred from refrigerated space 29, to the temperature of the refrigerated space. To maintain the refrigerated space 29 at an even temperature, a small electrical fan 30 or movable partitions 46 may be used to control the circulation of air through the lower heat exchanger 32.

Because the lower heat exchanger 32 is exposed to typically moist refrigerated air, and because the temperature of the refrigerated space may be maintained below the freezing point, frost may periodically form on exposed sections of the lower heat exchanger 32. To ensure efficient operation of lower heat exchanger 32, lower heat exchanger 32 must therefore be periodically defrosted.

Upper heat exchanger 31, on the other hand, is generally not exposed to outside air so that frost build-up is not a problem.

Prior to defrosting lower heat exchanger 32, liquid refrigerant contained in lower heat exchanger 32 must be removed to prevent heating of the cold plate 28 during defrosting. In the preferred defrosting method, to remove refrigerant from lower heat exchanger 32, the inlet valve 27 or **27*a* is closed, and the compressor 23 is turned on. Continued operation of the compressor 23 lowers the pressure in the tube assembly 20 and causes any remaining liquid refrigerant to vaporize and be transferred to the resevoir 25. Once the pressure within the tube assembly 20 drops to a value sufficiently low to ensure that all the refrigerant contained in the tube assembly 20 has vaporized, the compressor 23 is turned off. That may be accomplished manually, or by means of a pressure activated switch or by a timer. As compressors typically incorporate a check valve, the flow of refrigerant is prevented back into the tube assembly. If a one way check valve is not incorporated in the compressor one can be added to the system at 21. Above freezing temperature air, which may enter through baffles 47 which may be fitted into the walls of the refrigerated space 29, is then circulated through the lower heat exchanger 32 to rapidly remove any accumulated frost. To prevent excessive warming of the refrigerated space 29 during the defrost mode, the refrigerated space 29 may be fitted with partitions 45 or baffles 46 to limit the amount of room air that enters the main refrigerated space 29. A small electrical fan 30, which may be the same fan used to circulate air through lower heat exchanger 32** during the nonpowered cooling mode, may be used to enhance defrosting.

In some applications of the present invention, as for instance in small, portable refrigeration units, it may be practical to drain liquid refrigerant from lower heat exchanger 32 by tilting the refrigeration unit such that most of the liquid refrigerant drains into upper heat exchanger 32.

Accordingly, an improved cold storage refrigeration system and method has been presented. By interconnecting a cold storage unit and a refrigerated space with an extensive network of vertical heat pipes, the present invention provides a degree of non-powered cooling of the refrigerated space that was not possible in the prior art. The inherent efficiency of the heat pipes minimizes losses, such that non-powered cooling of the refrigerated space can be accomplished for extended periods of time. Such an ability to provide high capacity, nonpowered refrigeration for extended periods of time is especially useful where power costs vary at different times of day or where power is only intermittently available. Typical applications of the present invention include refrigeration systems for recreational vehicles, trucks, or boats, which often remain away from a centralized source of power for extended periods of time. The invention can also be used to take advantage of lower off-peak electricity rates that are available in many parts of the world by running a refrigerator or air conditioner embodying the invention in the powered mode during off-peak hours and in the unpowered mode during peak hours, resulting in a savings in energy costs. The invention can also be used to provide continuous cooling in areas where only intermittent power is available, such as in towns and villages in the lesser developed countries where local generators are run only during the daytime.

Although specific details are described herein, it will be understood that various changes can be made in the materials, details, arrangements and proportions of the various elements of the present invention without departing from the scope of the invention. For instance, although the specification describes the tube assembly as consisting of separately formed upper and lower heat exchangers, the entire tube assembly may be formed as a single element. The cold storage unit need not comprise a eutectic phase change material, but can comprise any material or device capable of absorbing heat. The invention can be used for cooling purposes other than conventional refrigeration, freezing and air conditioning, where temperatures lower than the ambient temperature are desired, as, for example, to provide emergency cooling for computer systems or superconducting generators in the event of power failures. Other variations and uses will be apparent to those skilled in the art.

We claim:

1. A refrigeration system for cooling substances to below ambient temperatures, said refrigeration system comprising:

a first insulated, enclosure means containing cold storage means capable of absorbing and emitting heat while remaining at a substantially constant temperature;

a tube assembly means comprising an upper heat exchanger means, a lower heat exchanger means, and a plurality of substantially vertical conduit means connecting said upper heat exchanger means with said lower heat exchanger means, said upper heat exchanger means being in thermal communication with said cold storage means and said lower heat exchanger means being in thermal communication with said substances to be cooled below ambient temperatures;

a refrigerant processing means, said refrigerant processing means comprising a compressor means, a condenser means, a refrigerant reservoir means and expansion valve means, each having an inlet and an outlet; said refrigerant processing means further comprising conduit means for connecting said outlet of said tube assembly means to said inlet of said compressor means, said outlet of said compressor means to said inlet of said condenser means, said outlet of said condenser means to said inlet of said reservoir means, said outlet of said reservoir means to said inlet of said expansion valve means and said outlet of said expansion valve means to said inlet of said tube assembly means, thereby forming a closed refrigerant loop;

a volume of a refrigerant contained within said refrigerant loop; and an inlet valve means located in said conduit means between said inlet of said tube assembly and said outlet of said reservoir;

whereby through selective operation of said compressor means and said inlet valve means said refrigeration system is capable of powered and non-powered cooling of said substances below ambient temperatures.

2. The refrigeration system of claim 1 wherein said substance to be cooled comprises air, such that said refrigeration system operates as an air conditioning unit.

3. The refrigeration system of claim 1 further comprising a second insulated enclosure means having an inside and an outside, said inside of said second insulated enclosure means for maintaining said substances at a first temperature below the ambient temperature on the outside of said second insulated enclosure means, said second insulated enclosure means being located adjacent to said first insulated enclosure means such that said inside of said second insulated enclosure means is in thermal communication with said lower heat exchanger of said tube assembly.

4. The refrigeration system of claim 3 wherein said substances comprise foods.

5. The refrigeration system of claim 3 wherein said first temperature is greater than 0 degrees centigrade.

6. The refrigeration system of claim 3 wherein said first temperature is less than 0 degrees centigrade, such that said second insulated enclosure means comprises a freezer.

7. The refrigeration system of claim 3 wherein said cold storage means comprises a eutectic material which exhibits a phase change at a temperature below said first temperature.

8. The refrigeration system of claim 3 wherein said upper heat exchanger means is enclosed substantially within said first insulated enclosure means.

9. The refrigeration system of claim 3 wherein said lower heat exchanger means is enclosed substantially within said second insulated enclosure means.

10. The refrigeration system of claim 8 wherein said upper heat exchanger means comprises a plurality of inverted U-shaped tube sections.

11. The refrigeration system of claim 9 wherein said lower heat exchanger means comprises a plurality of U-shaped tube sections.

12. The refrigeration system of claim 1 wherein said conduit means comprises copper tubing.

13. The refrigeration system of claim 1 wherein said refrigerant comprises a fluorocarbon refrigerant.

14. The refrigeration system of claim 3 wherein said second insulated enclosure means contains an electric air circulating fan.

15. The refrigeration system of claim 3 wherein said second insulated enclosure means contains baffles or partitions to control air circulation within said second insulated enclosure means.

16. The refrigeration system of claim 3 in which said tube assembly further comprises pressure switch means activated by changes in pressure within said tube assembly for controlling the operation of said inlet valve means and said compressor means.

17. The refrigeration system of claim 3 wherein said second insulated enclosure means further comprises thermostatic switch means activated by changes in temperature of said inside of said second enclosure means for controlling the operation of said inlet valve means and said compressor means.

* * * * *